US012178381B2

(12) United States Patent
Czarnecki et al.

(10) Patent No.: US 12,178,381 B2
(45) Date of Patent: Dec. 31, 2024

(54) DOS AIR BARRIER WITH DOOR CONDENSATION

(71) Applicant: WHIRLPOOL CORPORATION, Benton Harbor, MI (US)

(72) Inventors: Philip J. Czarnecki, Saugatuck, MI (US); Annie Marie Stuart, St. Joseph, MI (US); Mateusz Michal Wolowicz, Lower Silesian District (PL)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 18/341,843

(22) Filed: Jun. 27, 2023

(65) Prior Publication Data

US 2023/0329519 A1 Oct. 19, 2023

Related U.S. Application Data

(62) Division of application No. 17/245,738, filed on Apr. 30, 2021, now Pat. No. 11,723,512.

(51) Int. Cl.

| | |
|---|---|
| ***A47L 15/00*** | (2006.01) |
| ***A47L 15/42*** | (2006.01) |
| ***A47L 15/48*** | (2006.01) |

(52) U.S. Cl.

CPC ..... *A47L 15/488* (2013.01); *A47L 15/006* (2013.01); *A47L 15/0063* (2013.01); *A47L 15/4257* (2013.01); *A47L 15/4278* (2013.01); *A47L 15/483* (2013.01); *A47L 15/486* (2013.01); *A47L 2401/18* (2013.01); *A47L 2401/20* (2013.01); *A47L 2501/22* (2013.01)

(58) Field of Classification Search

None

See application file for complete search history.

(56) References Cited

U.S. PATENT DOCUMENTS

| | | | |
|---|---|---|---|
| 3,068,877 | A | 12/1962 | Jacobs |
| 8,313,583 | B2 | 11/2012 | May et al. |
| 9,510,728 | B2 | 12/2016 | Tuller |
| 10,295,256 | B2 | 5/2019 | Jadhav et al. |
| 10,470,640 | B2 | 11/2019 | Ryu et al. |
| 10,674,888 | B2 | 6/2020 | Kutto et al. |
| 2006/0236556 | A1 | 10/2006 | Ferguson et al. |
| 2008/0072935 | A1 | 3/2008 | Han et al. |
| 2010/0156259 | A1 | 6/2010 | May et al. |
| 2012/0298142 | A1 | 11/2012 | Junge et al. |

(Continued)

FOREIGN PATENT DOCUMENTS

| | | | |
|---|---|---|---|
| DE | 19818812 | A1 | 10/1999 |
| EP | 3020319 | A1 | 5/2016 |
| WO | 2017052796 | A1 | 3/2017 |

*Primary Examiner* — Levon J Shahinian

(74) *Attorney, Agent, or Firm* — Brooks Kushman, P.C.

(57) ABSTRACT

A dishwasher system for cleaning dishes may include a dishwasher tub configured to house dishes therein and run a dishwasher cycle, a door assembly configured to selectively seal the dishwasher tub, the door assembly including an inlet nozzle arranged on the inside of the door assembly, the inlet nozzle extending across the width of the door at the top of the door assembly to receive hot and moist air post wash from the dishwasher tub, and a duct fluidly connected to the inlet nozzle and configured to transfer the air through the door assembly and out an outlet nozzle during a drying phase of the dishwasher cycle prior to the door assembly being opened post-cycle.

20 Claims, 5 Drawing Sheets

(56) References Cited

U.S. PATENT DOCUMENTS

| | | | |
|---|---|---|---|
| 2014/0150286 | A1 | 6/2014 | Jadhav et al. |
| 2017/0150868 | A1 | 6/2017 | Ryu et al. |
| 2017/0319045 | A1 | 11/2017 | Wu et al. |
| 2019/0104916 | A1 | 4/2019 | Kim et al. |
| 2020/0093346 | A1 | 3/2020 | Lutz et al. |

DOS AIR BARRIER WITH DOOR CONDENSATION

CROSS-REFERENCE TO RELATED APPLICATIONS

This application is a division of U.S. application Ser. No. 17/245,738 filed Apr. 30, 2021, the disclosure of which is hereby incorporated in its entirety by reference herein.

TECHNICAL FIELD

Disclosed herein are air barriers for a dishwasher.

BACKGROUND

Dishwashers are often arranged under a countertop and within or adjacent to cabinetry, walls, etc. Upon opening a dishwasher door after a wash or dry cycle, warm and/or humid air may escape the dishwasher, exposing the countertop or cabinetry to high temperature and high humidity air. Such exposure may cause damage to the countertop or cabinetry, as well as the user interface arranged on the dishwasher door assembly.

SUMMARY

A dishwasher system for cleaning dishes may include a dishwasher tub configured to house dishes therein and run a dishwasher cycle, a door assembly configured to selectively seal the dishwasher tub, the door assembly including an inlet nozzle arranged on the inside of the door assembly, the inlet nozzle extending across the width of the door at the top of the door assembly to receive hot and moist air post wash from the dishwasher tub, and a duct fluidly connected to the inlet nozzle and configured to transfer the air through the door assembly and out an outlet nozzle during a drying phase of the dishwasher cycle prior to the door assembly being opened post-cycle.

A dishwasher system for cleaning dishes may include a dishwasher tub configured to house dishes therein and run a dishwasher cycle, a door assembly configured to selectively seal the dishwasher tub, a fan arranged within the dishwasher tub and configured to move hot and moist air towards the bottom of the tub, and to move cooler air towards the top of the tub, and a diffuser arranged at the bottom of the tub and configured to mix cool air from the door assembly with hot air delivered by the fan from the inside of the tub during door open cooling.

A dishwasher system for cleaning dishes may include a dishwasher having a tub configured to house dishes therein and run a dishwasher cycle having a plurality of phases including a drying phase, a door assembly configured to selectively seal the tub, the door assembly including an inlet nozzle arranged on the inside of the door assembly to receive hot and moist air from the tub following a rinse phase of the cycle, and a duct fluidly connected to the inlet nozzle and configured to transfer the air through the door assembly and out an outlet nozzle during the drying phase of the dishwasher cycle to cool the air within the tub.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
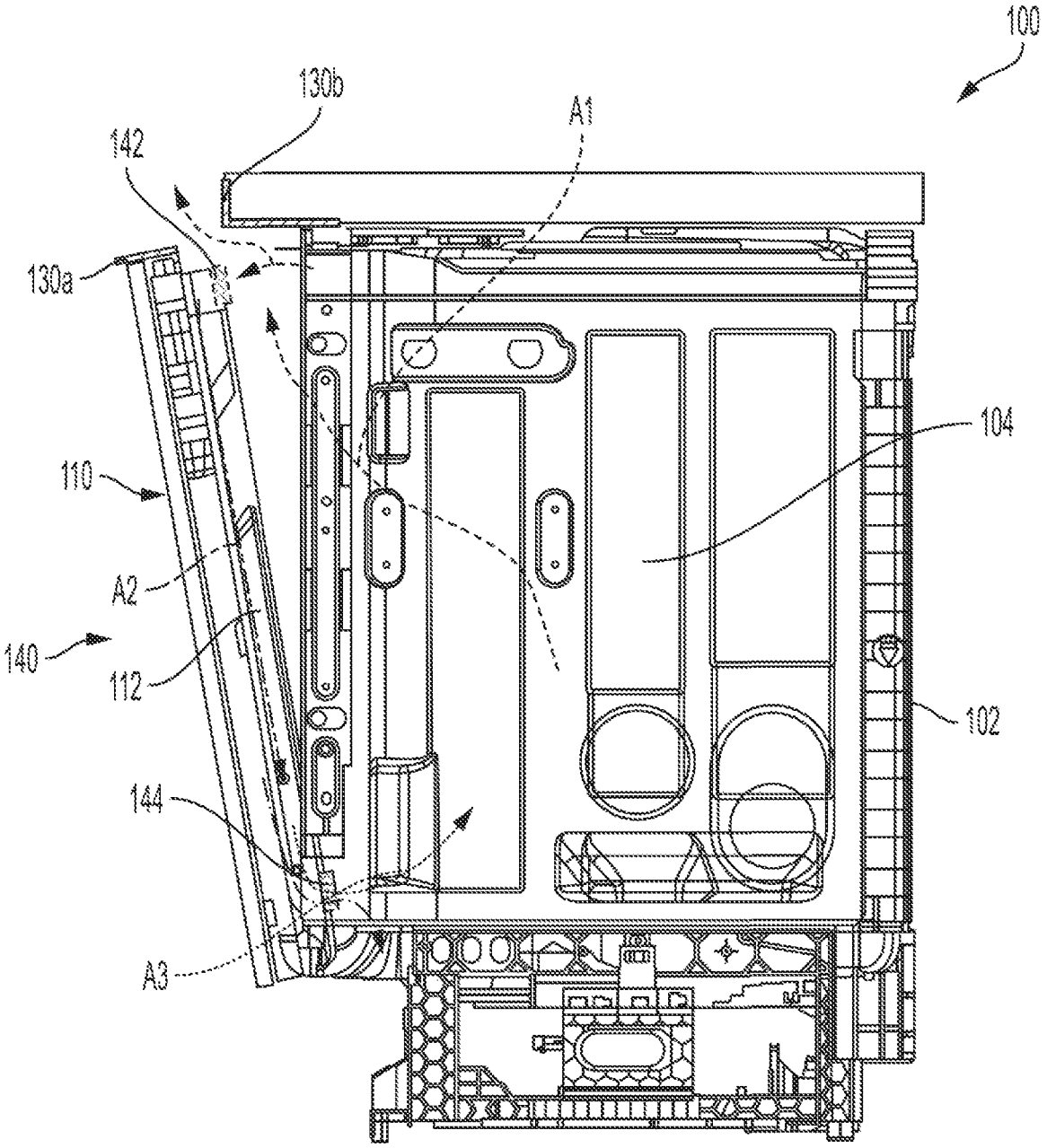
FIG. 1 illustrates an example side transparent view of a dishwasher with the door assembly being partially open in accordance with one example embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Dishwashers are often arranged under a countertop and within or adjacent to cabinetry, walls, etc. Upon opening a dishwasher door after a wash or dry cycle, warm and/or humid air may escape the dishwasher, exposing the countertop or cabinetry to high temperature and high humidity air. Such exposure may cause damage to the countertop or cabinetry. Some users leave the door open after the dry cycle to further dry the dishes. Over time, exposure to the high temperature high humidity air may damage the adjacent cabinetry due to droplets of condensation that may form. In addition to damage to the surrounding cabinetry, the user interface on the dishwasher may also be overly exposed to hot and moist air. This exposure may cause unwanted steering inputs that may disturb the cycle of the dishwasher.

Door opening drying systems may open the door of the dishwasher after the rinse phase and let the hot and moist air from the dishwasher vent out of the dishwasher. This may expedite the drying process, but can also cause the issues described above. In order to mitigate moisture build up around the cabinetry, some dishwasher systems deactivate the ability to open the dishwasher door during hot dry cycles. Some other solutions include a dedicated barrier, such as a protective foil, to be installed under the kitchen worktop. However, once a dishwasher is installed it may be difficult to add a barrier. Further, user satisfaction may be decreased with the inability to open the door during hot dry cycles.

Disclosed herein is an air circulation system configured to protect the cabinetry around the dishwasher as well as the user interface panel form moisture when a door opening system (DOS) is used. The air circulation system may also decrease the overall cycle time and allow for door opening following the dry phase sooner than other systems that do not include an air circulation system. The system improves moisture management both before and after the door is opened by the DOS system. The system may create an air suction barrier that protects the cabinetry and user interface from moisture. This allows for DOS activation at a higher temperature than 45 degrees Celsius and thus reduces the amount of time needed for the machine to cool down prior to DOS activation. This in turn reduces cycle time and also improves dry performance by increasing the evaporation rate of moisture on the dish load, especially on items that are normally hard to dry, such as plastics.

The system may also be active prior to the door opening, acting as a closed loop condensing dry system. The system may start drying dishes and increase total dry performance of the dishwasher, especially for consumers that open the door immediately after the cycle ends. When activated before door opening, the system can effectively dry, but also cool down the interior of the tub and the desired temperature for DOS activation may be achieved quicker, reducing cycle time.

In some examples, the entire circulation system may be arranged within the dishwasher door. Further, in some examples, the air temperature of the interior of the dishwasher may be decreased prior to opening of the door. Specifically, hot and dry air may be received from the cabinet opening into the dishwasher's fan arranged in the door cavity of the dishwasher. A diffuser arranged adjacent the fan and the interior tub air may be cooled down by mixing with the door cavity air in the diffuser. The mixed air may then be exhausted through the bottom of the door. When the tub air temperature has been lowered to a predefined threshold temperature, the door is opened. This allows air exiting the dishwasher to be cooled prior to the door opening, protecting the cabinetry from being exposed to hot and humid air.

In another example, the air circulation system may include an inlet nozzle arranged on the inside of the dishwasher door and extend the width of the door. The interior tub air may be received at this inlet nozzle and routed towards the fan. In some examples, the inlet nozzle may extend along a portion of the side panels of the door as well. Alternatively, a duct may be connected to the inlet nozzle and configured to transfer the hot hair through the door and out at an outlet nozzle.

FIG. 1 illustrates an example transparent side view of a dishwasher 100 in accordance with one example embodiment. The dishwasher 100 may be an automated appliance configured to clean kitchen equipment placed within the dishwasher 100. The kitchen equipment may include tableware such as dishes, glassware, cutlery and other utensils, and well as food preparation equipment such as pots and pans, slicers, presses, and peelers. To perform the cleaning, the kitchen equipment is placed on racks (not shown) inside a tub 104 of the dishwasher 100. A door assembly 110 is closed to form a watertight seal around the tub 104. Washing liquid and rinsing liquid is propelled from jets onto the kitchen equipment to clean dirt, grease, and other contaminants off the kitchen equipment. Though the examples described herein are generally related to in-home and personal use dishwashers, the same concepts may be applicable to commercial dishwashers as well.

The dishwasher 100 may include a frame 102 defining the exterior of the dishwasher 100. The frame 102 may be configured to interface with components exterior to the dishwasher 100 for installation, such as cabinets, countertops, floors, etc. The frame 102 may include a top, left side, right side, back, and bottom.

The tub 104 may define a hollow cavity or interior of the dishwasher for washing dishes. The tub 104 may define an open-face, or access opening with walls at the top, left side, right side, back and bottom. A chassis (not individually labeled) may be arranged between the frame 102 and the tub 104 to maintain the tub 104 within the frame. The chassis may support the tub 104 and allow for maintaining space between the frame 102 and the tub 104.

The door assembly 110 may be arranged at a front of the dishwasher 100. The door assembly 110 may be attached to the dishwasher at the bottom front edge of the frame 102 and may be hinged thereat to move between open and closed positions. In the closed position, the door assembly 110 may seal the tub 104 at the access opening. In the open position, the cavity may be accessible via the access opening. In another example, the door assembly 110 may operate as a drawer that can be slidably extended outward from the front of the dishwasher 100 to move into the open position, and slidably retracted back into the dishwasher 100 to the closed position to seal the tub 104.

The dishwasher 100 may be arranged near or within cabinetry such as kitchen cabinets and surfaces, including countertops. Certain moisture areas 130 may be arranged at or near the top of the dishwasher door assembly 110 and be susceptible of being exposed to hot and humid air from the dishwasher upon door opening. This may include a first moisture area 130*a* where a user interface may be arranged. A second moister area 130*b* may abut the cabinetry surrounding the dishwasher 100.

The dishwasher 100 may include a spray system for spraying liquid within the tub 104 during a cleaning cycle. In an example cycle, washing liquid including soap may first be sprayed onto the kitchen equipment, and then once washed, rinsing liquid without soap may then be sprayed onto the kitchen equipment. The spray system may include various jets for providing the liquid onto the surfaces of dishes during the automated washing and rinsing operations. The dishwasher 100 may also include a heating system or heating element for heating the tub 104 for drying during a drying phase of the cycle. In combination with the moisture provide by the spray system, the tub 104 may be configured to house hot and humid air therein during at least the wash and dry cycles. In some systems, current door opening temperatures are set at a predefined threshold, such as 45 degrees Celsius. That is, the interior air of the dishwasher 100 should first cool to this temperature prior to door opening. Some machines, such as New Energy Label B-class machines may achieve high peak temperatures of around 47 degrees. Cooling time to reach 45 degrees from this high peak temperature may take upwards of 20 minutes, thus adding to the cycle time. Some intensive cycles reach peak temperatures of 65 degrees, which may take upwards of 90 minutes to cool down to 45 degrees.

In order to obviate this lengthy cool time, the dishwasher 100 may include an air circulation system 140 configured to dry and cool the air within the tub 104. The system 140 may include at least one inlet nozzle 142 arranged on the inside of the dishwasher door assembly 110. The inlet nozzle 142 may be configured to receive hot and moist air from the dishwasher tub 104. In the example shown in FIG. 1, the inlet nozzle 142 may be arranged at the top of the door assembly 110. The inlet nozzle 142 may extend across the entire width of the door assembly 110. For example, the inlet nozzle 142 may be arranged on the inside of the door assembly 110 such that when the door assembly 110 is in a closed position, the inlet nozzle 142 is facing inwards towards the tub 104.

The inlet nozzle 142 may be configured to receive hot and moist air from within the tub 104 along a first airflow path A1. The inlet nozzle 142 may be connected to a duct 112 within the door assembly 110. The duct 112 may be a hollow tube or channel created within the door assembly 110. An outlet nozzle 144 is arranged at the end of the duct 112. Air may flow into the inlet nozzle 142, through the duct 112 along a second airflow path A2 and out of the outlet nozzle 144 along a third airflow path A3. As air is transferred through the duct 112 along the second airflow path A2, the air may condense and cool prior to the air being released back into the tub 104 through the outlet nozzle 144. Condensation may accumulate as the air cools and moisture is collected. This condensation may be collected at the outlet nozzle 144. This fluid or water may be released by the outlet nozzle 144 and drained after completion of the dishwasher cycle.

While the door assembly 110 is shown in a partially open arrangement, the above process may be carried out during the dishwashing cycle, as well or post cycle. The cycles and phases of the cycle are discussed in more detail below with respect to FIG. 5. The inlet nozzle 142 may suck the hot and moist air into the duct 112 and as the air travels down the duct 112, the air may cool and be re-released into the tub 104 without the additional moisture. During a drying phase of the cycle, this may be of particular advantage.

In one embodiment, and although not shown in the figures, the inlet nozzle 142 may include a gate mechanism. The gate mechanism may selectively open and close the inlet nozzle 142. The gate mechanism may be controlled based on the dishwashing cycle. For example, the gate mechanism may be closed during the wash portion of the cycle, but opened during the dry to help product dry and cool air back into the tub 104.

The inlet nozzle 142 may also receive the hot and moist air along the first airflow path A1 upon door opening as well as during the drying portion of the cycle. While cooling the air and thus removing moisture from the air during the drying phase may aid in more quickly drying the dishes and cooling the air inside the tub 104, some hot and moist air may still escape from the tub upon door opening. In order to protect the first moisture area 130*a* and second moister area 130*b* further, the inlet nozzle 142 may further continue to receive at least a portion of the hot and moist air that may initially escape from the tub 104 when the door assembly 110 is first opened.

While the outlet nozzle 144 is shown as being arranged at the base or bottom of the door assembly 110, the outlet nozzle 144 may be arranged at other locations along the door assembly 110. The duct 112 may also have varying configurations. In one example, the duct 112 may form a U-shape and the outlet nozzle 144 is arranged at the top of the door assembly 110 near the user interface. In this configuration, air is received at the inlet nozzle 142 and cool and dry air is released near the user interface after cooling down through the duct 112. The outlet nozzle 144 may also be arranged at the side of the door assembly 110 to vent cool air out one or both sides of the door assembly 110.

The dishwasher 100 may include a controller to control the components herein such as motors, gears, sensors, water flow, sprayers, heating elements, fans, gate mechanisms, door assemblies, etc. The controller may include the machine controller and any additional controllers provided for controlling any of the components of the dishwasher 100. Many known types of controllers can be used for the controller. It is contemplated that the controller is a microprocessor-based controller that implements control software and sends/receives one or more electrical signals to/from each of the various working components to implement the control software.

The controller may also include or be coupled to a memory configured to include instructions and databases to carry out the systems and processes disclosed herein. The controller may also be part of the general dishwasher control system that controls wash cycles and other systems. The controller may receive data and commands from the system components and may also have an antenna for wireless communication with the devices within the dishwasher 100, as well as device remote from the dishwasher 100. In one example, the controller may receive commands from the user interface on the dishwasher 100. Additionally or alternatively, the controller may receive commands from a mobile application on device remote from the dishwasher 100.

Figure 2:
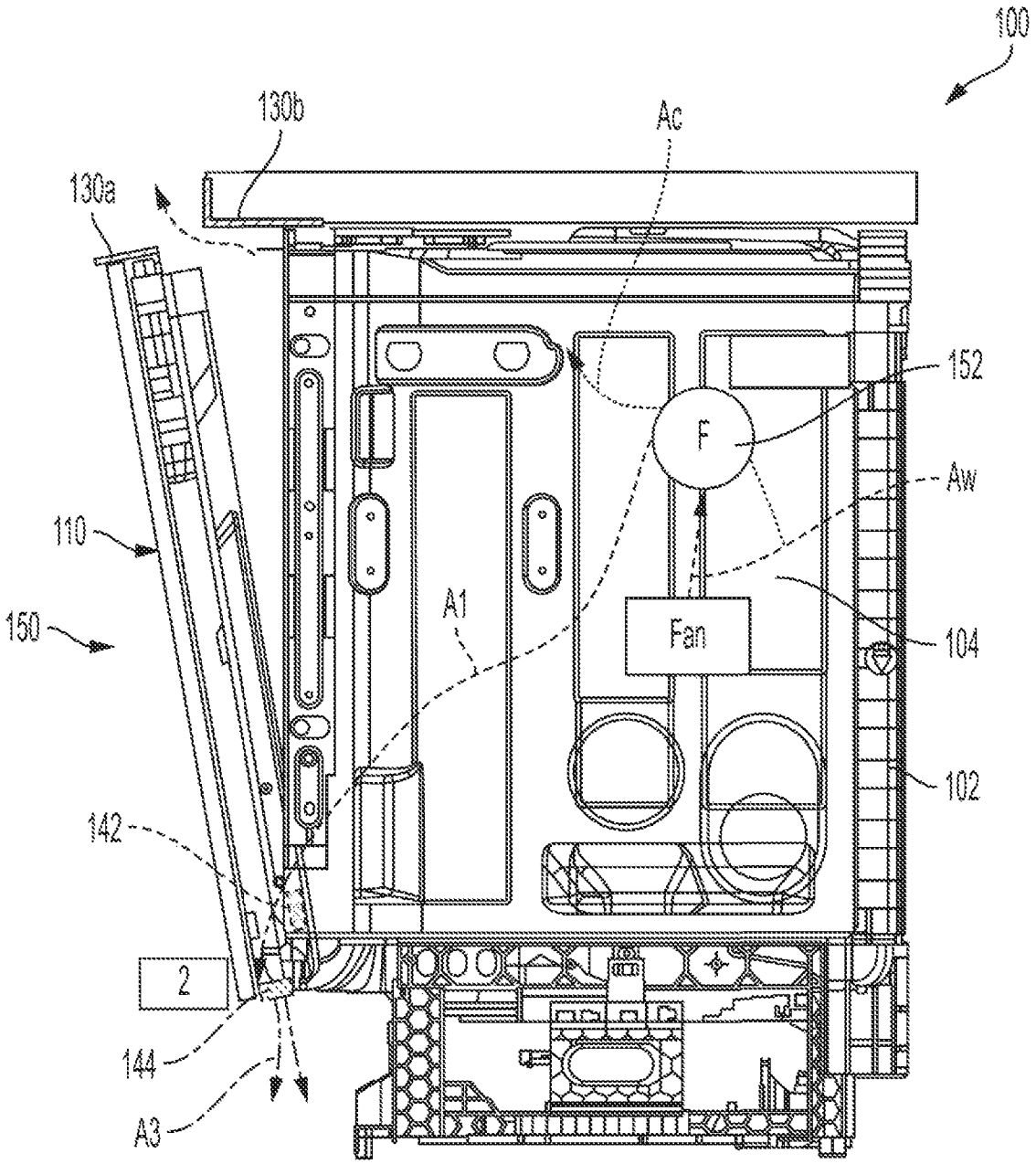
FIG. 2 illustrates a side transparent view of another dishwasher with the door assembly being partially open.

FIG. 2 illustrates a side transparent view of another dishwasher 100 with the door assembly 110 being partially open. Similar to the example in FIG. 1, the dishwasher 100 may be arranged near or within cabinetry such as kitchen cabinets and surfaces, including countertops. Certain moisture areas (not shown in FIG. 2) may be arranged at or near the top of the dishwasher door assembly 110 and be susceptible of being exposed to hot and humid air from the dishwasher upon door opening. To reduce the cooling time before opening the door, as well as prevent damage to the nearby cabinetry, the dishwasher 100 may include another example air circulation system 150.

The air circulation system 150 may include a fan 152 arranged within the dishwasher tub 104. The fan 152 may be arranged at or near the top of the tub 104. The fan 152 may include a fan assembly as part of a vent assembly of the dishwasher. The fan 152 may also be a standalone fan powered by a fan motor and powered by the dishwasher's electrical system. The fan 152 may be an addition to the fan and vent combination traditionally installed in a dishwasher. The fan 152 may operate to cool the air within the tub 104 and transfer the warmer air downward toward the bottom of the tub 104. For example, the fan 152 may receive warm air Aw. By circulating the warm air Aw, the fan may produce cooler air Ac. The cooler air Ac may be transferred upward in the tub 104 and to provide the cooler air Ac near the top of the dishwasher 100. This allows cooler air flow around the cabinetry, thus reducing condensation build up at the countertop there above. The remaining warmer air may be pushed downward along the first airflow path A1.

In the example of FIG. 2, the inlet nozzle 142 may be arranged at the base of the door assembly 110 towards its hinge and at the bottom of the tub 104. The inlet nozzle 142 may receive air from the first airflow path A1. The outlet nozzle 144 may receive the air from the inlet nozzle 142 and output the air to the exterior of the dishwasher 100 at the bottom of the door assembly 110, as illustrated by the third airflow path A3. By exuding the air out of the dishwasher 100 at the bottom of the door assembly 110, hot moist air is prevented from being concentrated at the first moisture area 130*a* and second moister area 130*b* upon door opening. Further, the fan 152 aids in cooling the tub 104 quicker, allowing for shorter cycle times.

Figure 3:
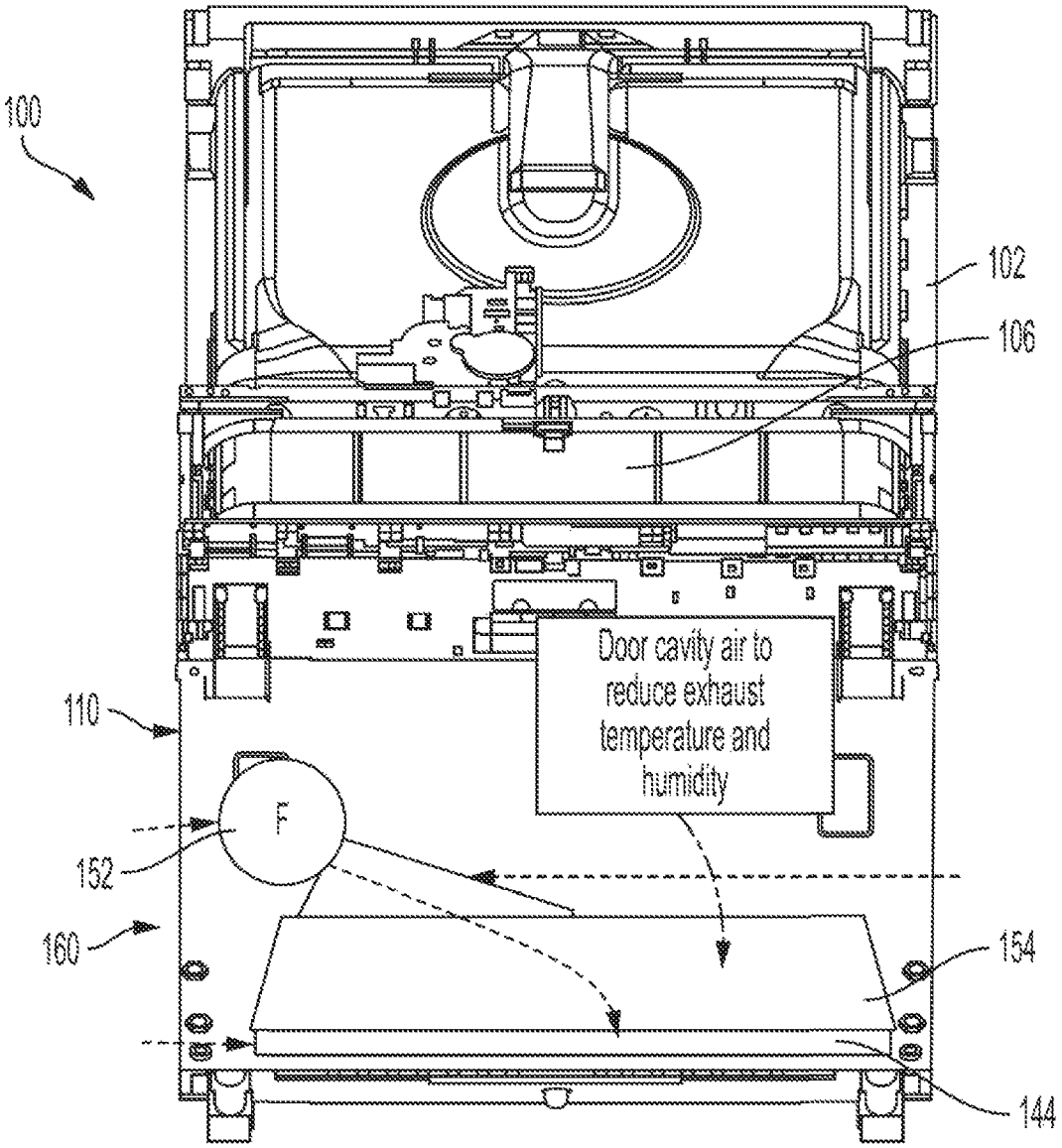
FIG. 3 illustrates a front transparent view of another dishwasher 100 with the door assembly partially open.

FIG. 3 illustrates a front transparent view of another dishwasher 100 with the door assembly 110 partially open having another example air circulation system 160. When the door assembly 110 is opened, cool air from the exterior of the dishwasher 100 may enter the tub 104. Concurrently, however, warm and moist air may exit the dishwasher 100, typically at the top of the dishwasher 100 when the door assembly 110 is first opened. Similar to the dishwasher 100 in FIG. 2, the air circulation system 140 may include the fan 152. The fan 152 may cool air within the tub 104 pushing the cooler air Ac upwards and warmer air downwards.

The system 140 may include a diffuser 154 arranged at the bottom of the tub 104. The diffuser 154 may be configured to receive the warmer air from the fan 152 and mix the cooler air coming from the open door assembly 110. This may decrease the exhausted air temperature and humidity, thus protecting the surrounding cabinetry.

Figure 4C:
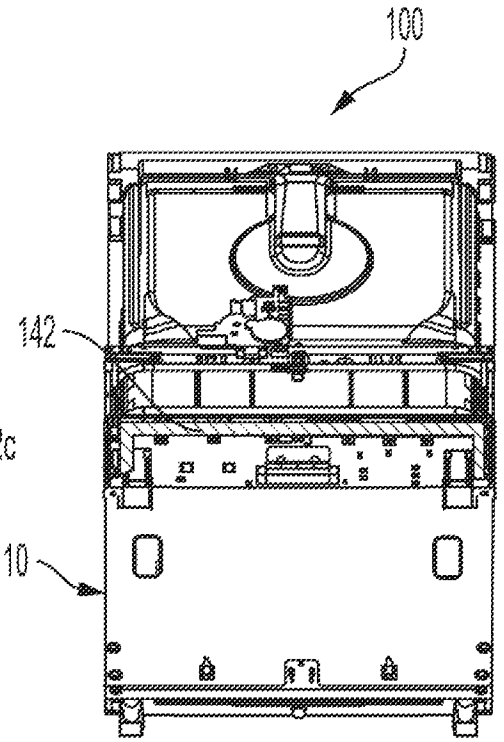
FIG. 4C illustrates a front view of the dishwasher of FIG. 1 having another example inlet nozzle with the door assembly partially open.
Figure 4B:
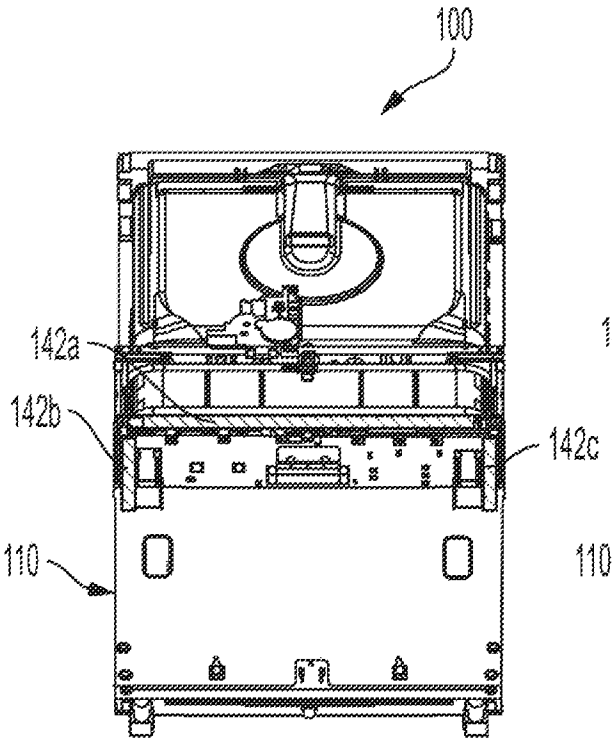
FIG. 4B illustrates a front view of the dishwasher of FIG. 1 having another example inlet nozzle with the door assembly partially open.
Figure 4A:
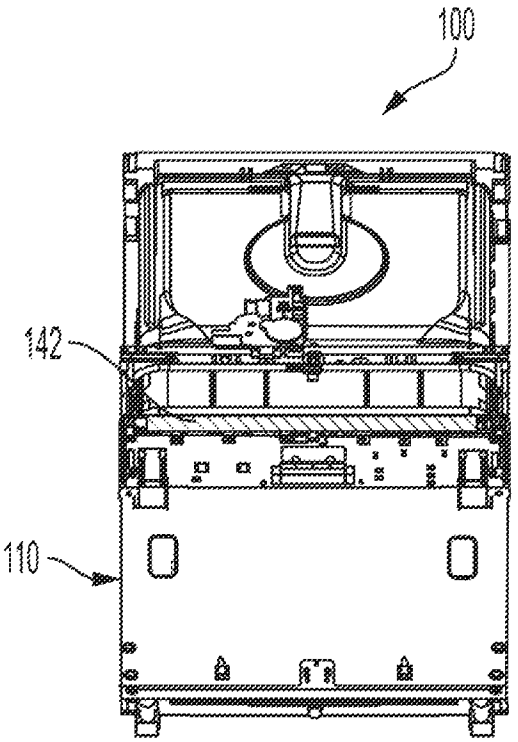
FIG. 4A illustrates a front view of the dishwasher of FIG. 1 having an example inlet nozzle with the door assembly partially open.

FIGS. 4A-4C illustrates front views of the dishwasher 100 of FIG. 1 with the door assembly 110 partially open. The inlet nozzle 142 is illustrated as being arranged at the upper portion of the door assembly 110. In FIG. 4A, the inlet nozzle 142 extends across the top of the door assembly 110. This may allow the inlet nozzle 142 to receive as much of the hot and moist air as possible, further protecting the cabinetry and aiding in the fast cooling of the tub 106.

FIG. 4B illustrates an example where the inlet nozzle 142 includes a plurality of nozzles, each arranged along the door assembly 110. In this example, a first inlet nozzle 142*a* is arranged across the top of the door assembly 110, similar to the example in FIG. 4A. A second inlet nozzle 142*b* may be arranged at the side of the door assembly 110. A third inlet nozzle 142*c* may be arranged at the other side of the door assembly 110. Having these additional inlet nozzles may facilitate an increase in air volume to be received at the inlet nozzles 142. While the second inlet nozzle 142*b* and the third inlet nozzle 142*c* are shown as partially extending down the sides of the door assembly 110, the second inlet nozzle 142*b* and the third inlet nozzle 142*c* may each extend the full length of the sides of the door assembly 110.

FIG. 4C illustrates an example where the inlet nozzle 142 forms a U-shaped configuration configured to extend across the top of the door assembly 110 and partially down each side. This is similar to the configuration shown in FIG. 4B with the inlet nozzle 142 forming a cohesive and single inlet nozzle 142.

The inlet nozzle 142 configurations in FIGS. 4A-4C may be in fluid communication with the duct 112 of FIG. 1, allowing for air to be transferred from the inlet nozzle 142, cooled through the duct 112, and then forced out at the outlet nozzle 144. With the addition of the nozzles at the sides of the door assembly 110, hot and moist air may be further vented away from cabinetry arranged on the sides of the dishwasher 100, in addition to the worktop above and the user interface.

Figure 5:
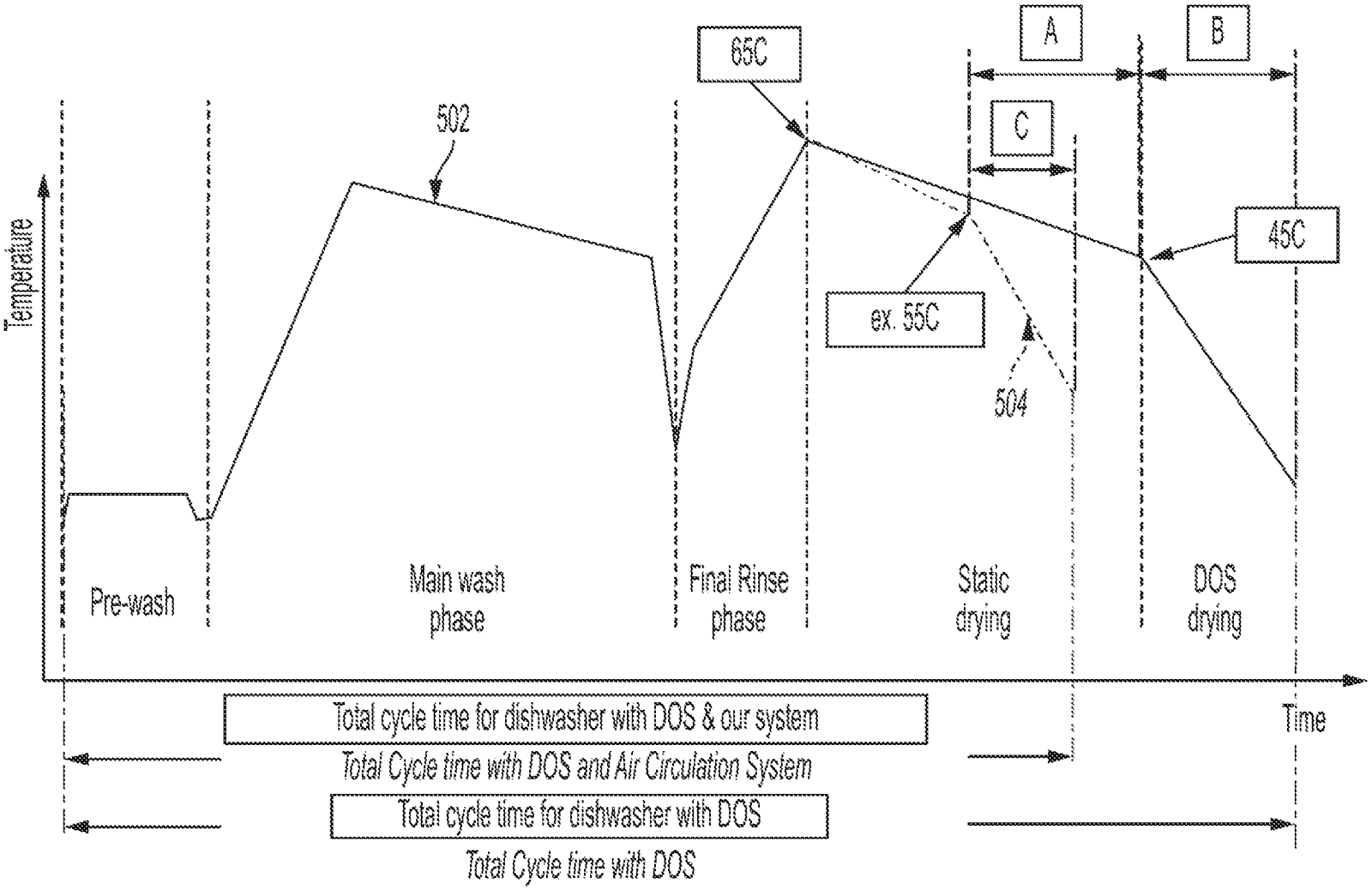
FIG. 5 illustrates an example chart of interior dishwasher temperature over time of a dishwasher cycle.

FIG. 5 illustrates an example chart of interior dishwasher temperature over time of a dishwasher cycle. Each cycle may include a plurality of phases. FIG. 5 illustrates a first cycle 502. FIG. 5 also illustrates a second cycle 504 that includes the air circulation systems 140 as described above. Both cycles may start with a pre-wash phase. In this phase the dishes may be rinsed, the water and spray may be concurrently or subsequently warmed to prepare for the main wash phase. During the main wash phase, the temperature of the dishwasher tub 104 may increase due to the heat of the water being used to wash the dishes. At an initiation of a final rinse phase, the temperature may drop slightly, but continue to increase due to the heat of the water, as well as the heating element. At the end of the final rinse phase, the temperature of the tub 104 may be up to 65 degrees Celsius.

For the pre-wash, main wash, and final rinse phases, the first cycle 502 and second cycle 504 are the same. The second cycle 504 may deviate from the first cycle 502 during the static drying phase. In this phase, the first cycle 502 may dry the dishes by activating the heating element. The heating element may stay activated for a predetermined amount of time to dry the dishes. For the first cycle 502, the static drying phase may take approximately 90 minutes, depending on the type of wash cycle (e.g., light wash, heavy wash, etc.). At the end of a typical static drying phase, the tub temperature may be approximately 45 degrees Celsius.

Once the tub temperature reaches approximately 45 degrees Celsius, the door assembly 110 may be opened and door open drying may commence during the door open system phase. However, the second cycle 504 may implement the one of the air circulation systems 140, 150 during the static drying phase. During this time, hot and moist air may be received at the inlet nozzle 142 and cooled. The cool air may be vented back into the tub 104, or the cool air may be vented outside of the dishwasher 100. Regardless, additional hot and moist air is removed from the tub 104, thus allowing the tub 104 to cool at a faster rate than that of the first cycle 502. Thus, the tub temperature may reach the threshold temperature for door opening sooner by decreasing the static drying phase time. For example, dishwashers that include the air circulation system 140 may cool to the predetermined temperature (e.g., 45 degrees Celsius) in approximately 40 minutes.

The air circulation system 140 may initiate immediately after draining of the water in the final rinse phase. This water may have a temp of 65 degrees Celsius. Thus, the air circulation system 140 can initiate even prior to the DOS drying phase and start cooling the tub temperature during the static drying phase to lower the total cycle time.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A dishwasher system for cleaning dishes, comprising:

a dishwasher tub configured to house dishes therein and run a dishwasher cycle;

a door assembly configured to selectively seal the dishwasher tub, the door assembly including an inlet nozzle arranged on the inside of the door assembly, the inlet nozzle extending across the width of the door assembly at the top of the door assembly to receive hot and moist air post wash from the dishwasher tub; and a duct fluidly connected to the inlet nozzle and configured to transfer the air through the door assembly and out through an outlet nozzle during a drying phase of the dishwasher cycle prior to the door assembly being opened post-cycle.

2. The dishwasher system of claim 1, wherein the inlet nozzle extends at least partially over the sides of the door assembly forming a U-shaped nozzle.

3. The dishwasher system of claim 1, wherein the inlet nozzle includes a plurality of inlet nozzles including a pair of side nozzles arranged along at least a portion of the sides of the door assembly to receive moist and hot air.

4. The dishwasher system of claim 1, wherein the duct extends from the top of the door assembly to the bottom of the door assembly.

5. The dishwasher system of claim 4, wherein the outlet nozzle is arranged at the bottom of the door assembly and is configured to transfer the air from the duct out to an area external to the dishwasher system.

6. The dishwasher system of claim 4, wherein the outlet nozzle is arranged at the bottom of the door assembly facing the tub and is configured to transfer the air from the duct to the dishwasher tub.

7. The dishwasher system of claim 1, wherein the inlet nozzle faces inwards towards the tub on the inside of the door assembly.

8. A dishwasher system for cleaning dishes, comprising:

a dishwasher tub configured to house dishes therein;

a door assembly configured to selectively seal the dishwasher tub, an inlet nozzle arranged on the door assembly, the inlet nozzle extending across the width of the door assembly at the top of the door assembly to receive hot and moist air from the dishwasher tub; and an outlet nozzle arranged within the tub; and a duct fluidly connected to the inlet nozzle and configured to transfer the air through the door assembly and out through the outlet nozzle during a drying phase of a dishwasher.

9. The dishwasher system of claim 8, wherein the inlet nozzle extends at least partially over the sides of the door assembly forming a U-shaped nozzle.

10. The dishwasher system of claim 8, wherein the inlet nozzle includes a plurality of inlet nozzles including a pair of side nozzles arranged along at least a portion of the sides of the door assembly to receive moist and hot air.

11. The dishwasher system of claim 8, wherein the duct extends from the top of the door assembly to the bottom of the door assembly.

12. The dishwasher system of claim 11, wherein the outlet nozzle is arranged at the bottom of the door assembly and is configured to transfer the air from the duct out to an area external to the dishwasher system.

13. The dishwasher system of claim 11, wherein the outlet nozzle is arranged at the bottom of the door assembly facing the tub and is configured to transfer the air from the duct to the dishwasher tub.

14. The dishwasher assembly of claim 8, wherein the duct is configured to transfer air through the door assembly and out through the outlet nozzle during the drying phase and prior to the door assembly being opened post-cycle.

15. The dishwasher assembly of claim 14, wherein the inlet nozzle includes a pair of side nozzles arranged along the sides of the door assembly to receive moist and hot air.

16. A dishwasher system for cleaning dishes, comprising:

a dishwasher tub configured to house dishes therein and run a dishwasher cycle;

a door assembly configured to selectively seal the dishwasher tub, the door assembly including a U-shaped inlet nozzle arranged on the inside of the door assembly, the inlet nozzle extending across the width of the door assembly at the top of the door assembly to receive hot and moist air post wash from the dishwasher tub; and a duct fluidly connected to the inlet nozzle and configured to transfer the air through the door assembly and out through an outlet nozzle during a drying phase of the dishwasher cycle prior to the door assembly being opened post-cycle.

17. The dishwasher system of claim 16, wherein the inlet nozzle extends at least partially over the sides of the door assembly forming the U-shaped nozzle.

18. The dishwasher system of claim 16, wherein the inlet nozzle extends at least over and along the entire sides of the door assembly forming the U-shaped nozzle.

19. The dishwasher system of claim 16, wherein the duct extends from the top of the door assembly to the bottom of the door assembly and the outlet nozzle is arranged at the bottom of the door assembly and is configured to transfer the air from the duct out to an area external to the dishwasher system.

20. The dishwasher system of claim 16, wherein the duct extends from the top of the door assembly to the bottom of the door assembly and the outlet nozzle is arranged at the bottom of the door assembly facing the tub and is configured to transfer the air from the duct to the dishwasher tub.

* * * * *